US011672314B2

(12) United States Patent
Rodriguez

(10) Patent No.: US 11,672,314 B2
(45) Date of Patent: Jun. 13, 2023

(54) MODULAR DRAWERED LUGGAGE SOLUTION AND SYSTEM

(71) Applicant: Diana R Rodriguez, Miami, FL (US)

(72) Inventor: Diana R Rodriguez, Miami, FL (US)

( * ) Notice: Subject to any disclaimer, the term of this patent is extended or adjusted under 35 U.S.C. 154(b) by 261 days.

(21) Appl. No.: 17/191,635

(22) Filed: Mar. 3, 2021

(65) Prior Publication Data

US 2021/0393007 A1 Dec. 23, 2021

Related U.S. Application Data

(63) Continuation-in-part of application No. 16/906,904, filed on Jun. 19, 2020, now abandoned.

(51) Int. Cl.

| | |
|---|---|
| ***A45C 5/06*** | (2006.01) |
| ***A45C 5/03*** | (2006.01) |
| ***A45C 13/10*** | (2006.01) |
| ***A45C 13/30*** | (2006.01) |
| ***A45C 5/14*** | (2006.01) |
| ***A45C 13/03*** | (2006.01) |
| ***A45C 13/02*** | (2006.01) |

(52) U.S. Cl.

CPC ..... *A45C 5/065* (2013.01); *A45C 5/03* (2013.01); *A45C 5/146* (2013.01); *A45C 13/03* (2013.01); *A45C 13/103* (2013.01); *A45C 13/30* (2013.01); *A45C 2013/025* (2013.01); *A45C 2013/303* (2013.01)

(58) Field of Classification Search

CPC ..... A45C 5/065; A45C 5/03; A45C 5/146; A45C 13/03; A45C 13/103; A45C 13/30; A45C 2013/025; A45C 2013/303

See application file for complete search history.

(56) References Cited

U.S. PATENT DOCUMENTS

| | | | | |
|---|---|---|---|---|
| 1,106,581 | A * | 8/1914 | Peppard | A45C 5/00 190/4 |
| 1,818,525 | A * | 8/1931 | Angulo | A47B 61/06 312/289 |
| 5,518,258 | A * | 5/1996 | Cox | B25H 1/14 280/30 |
| 8,210,548 | B1 * | 7/2012 | Agyemang | A61B 50/13 280/47.35 |
| 2005/0145458 | A1 * | 7/2005 | Cohen | A47B 61/06 190/110 |

(Continued)

*Primary Examiner* — Tri M Mai

(74) *Attorney, Agent, or Firm* — Michael L. Greenberg, Esq.; Greenberg & Lieberman, LLC

(57) ABSTRACT

A luggage apparatus and solution equipped with drawers and retractable wheels configured to facilitate the organization and segmentation of items packed for transit providing for ease of access of specific items without the need to unpack the entirety of the luggage. The apparatus is equipped with multiple compartments, as well as multiple drawers. Each drawer has a lock which is configured to bind against multiple sides of each drawer to ensure the drawers remain in the closed position even when subjected to shock. Drawers are further segmented with fabric dividers. A primary zippered compartment and top zippered compartment provide additional storage space. A carry-on embodiment and a large embodiment are disclosed. The carry-on embodiment employs solely fabric dividers in lieu of drawers, and has a retractable table integrated into the handle.

6 Claims, 10 Drawing Sheets

(56) References Cited

U.S. PATENT DOCUMENTS

| | | | | |
|---|---|---|---|---|
| 2007/0089954 | A1* | 4/2007 | Eardley | A45C 5/065<br>190/110 |
| 2013/0175129 | A1* | 7/2013 | Rankin | A45C 5/14<br>190/18 A |
| 2015/0366307 | A1* | 12/2015 | Loomis | A45C 5/03<br>190/103 |
| 2019/0150578 | A1* | 5/2019 | Robicheaux | A45C 13/10 |

* cited by examiner

MODULAR DRAWERED LUGGAGE SOLUTION AND SYSTEM

CONTINUITY

This application is a continuation-in-part application of non-provisional patent application Ser. No. 16/906,904, filed on Jun. 19, 2020, and priority is claimed thereto.

FIELD OF THE PRESENT INVENTION

The present invention relates to the field of travel solutions, and more specifically relates to modular drawered luggage system configured to facilitate access to luggage contents via individual locked segments present as sliding drawers.

BACKGROUND OF THE PRESENT INVENTION

Every year, millions of individuals travel the world via airline, bus, train, or automobile. Conventionally, these individuals are prone to pack at least one suitcase or other form of luggage to facilitate the transport of their daily necessities, including clothing, shoes, toiletries, and other common goods pertinent for travel.

Many individuals unpack their suitcases into dresser drawers of a hotel upon arrival to facilitate access to their items, and to feel more settled at the travel location. Unfortunately, this process often takes a good deal of time, and must be undone once it becomes time to checkout of the hotel. If the suitcase itself was equipped with drawers, this process would not be necessary.

Additionally, conventional luggage such as suitcases and carry-ons are generally equipped with one to three compartments, generally with a single large compartment, and one or two small, zippered flap compartments. Many times, individuals have difficulty packing in an organized manner due to the way in which conventional luggage is designed. As such, nearly every packed item is disposed in the same large compartment of the suitcase, with usually nothing but a flap of fabric to form any sort of separation between categories of items. Due to this disorganization, individuals often have trouble finding specific desired items upon arrival at their destination. Additionally, since most items are positioned in the same compartment, many items may shift during transit, especially if the luggage is checked at the airport, and therefore leaves the possession of the owner for a period of time.

If there were a way in which luggage contents could be easily organized within a suitcase, such as within specific, lockable drawers such that access to specific items when needed can be expedited, more time would be saved, and less items would be shifted from their desired position within the luggage during transit.

Thus, there is a need for a new drawered luggage solution configured to provide segmented storage areas within the luggage which facilitates access to specific sections of the luggage without the need to open the entirety of the luggage. Such an apparatus and solution is preferably equipped with multiple locks which ensure that each drawer remains closed until the owner physically opens the desired drawer. Similarly, such an apparatus and solution is preferably configured with a rear access zipper which facilitates the storage of longer items such as a suit or dress, and, when the rear portion is folded down, helps to ensure adequate weight distribution of the overall payload.

SUMMARY OF THE PRESENT INVENTION

The present invention is a drawered luggage apparatus and method of use thereof configured to expedite the packing and unpacking processes while facilitating access to packed items when needed via multiple sliding drawers. Cloth dividers and/or removable inserts are preferably present within each drawer. The dividers and removable inserts provide additional segmentation for the optimal organization of the user's packed items. A rear of the luggage apparatus is preferably configured to open via at least one fabric hinge to facilitate access to a vertical compartment while the luggage apparatus remains upright, or alternately, the rear may be opened via a vertical, side-mounted cloth hinge to facilitate opening of the rear compartment similar to a conventional door. The apparatus is preferably available in at least two varieties, including an embodiment suitably sized as a carry-on luggage, as well as an embodiment suitable as a large checked luggage. Each embodiment is preferably equipped with retractable wheels, a retractable handle, multiple locks, and are preferably composed of lightweight materials. If needed, a weight may be added to a bottom of the large luggage embodiment which may be extended out and away from the body to counter the weight of the drawers when they are opened.

Such an apparatus and solution is ideally suited for short term trips, or multi-destination trips by individuals or families wishing to remain organized while traveling. The primary goal of the present invention is for users to not need to unpack upon arrival at the travel destination, and to ensure that the luggage contents remains organized in an easily accessible way as if the user had actually unpacked the luggage at the destination. Similarly, the present invention affords users an easy means by which they may unpack their belongings quickly and easily within the removable inserts such that items are unpacked from the luggage without being truly unpacked from components of the luggage. If the cleanliness of the drawers in the furniture of the hotel are problematic, the user can pull out the inserts and insert them into the drawers of the furniture of the room, and the clothes will never have to come into contact with the furniture. Additionally, it should be noted that the insert of the jewelry drawer can be used for bath and hair products so that the user may remove the insert and carry it to the bathroom if needed. It should be noted that the insert amounts to a large rectangle with walls equipped with subdivided cubbies within.

The following brief and detailed descriptions of the drawings are provided to explain possible embodiments of the present invention but are not provided to limit the scope of the present invention as expressed herein this summary section.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

The present invention will be better understood with reference to the appended drawing sheets, wherein.

DETAILED DESCRIPTION OF THE PREFERRED EMBODIMENT

The present specification discloses one or more embodiments that incorporate the features of the invention. The disclosed embodiment(s) merely exemplify the invention. The scope of the invention is not limited to the disclosed embodiment(s).

References in the specification to "one embodiment," "an embodiment," "an example embodiment," etc., indicate that the embodiment described may include a particular feature, structure, or characteristic, but every embodiment may not necessarily include the particular feature, structure or characteristic. Moreover, such phrases are not necessarily referring to the same embodiment, Further, when a particular feature, structure, or characteristic is described in connection with an embodiment, it is submitted that it is within the knowledge of one skilled in the art to effect such feature, structure, or characteristic in connection with other embodiments whether or not explicitly described.

Figure 1:
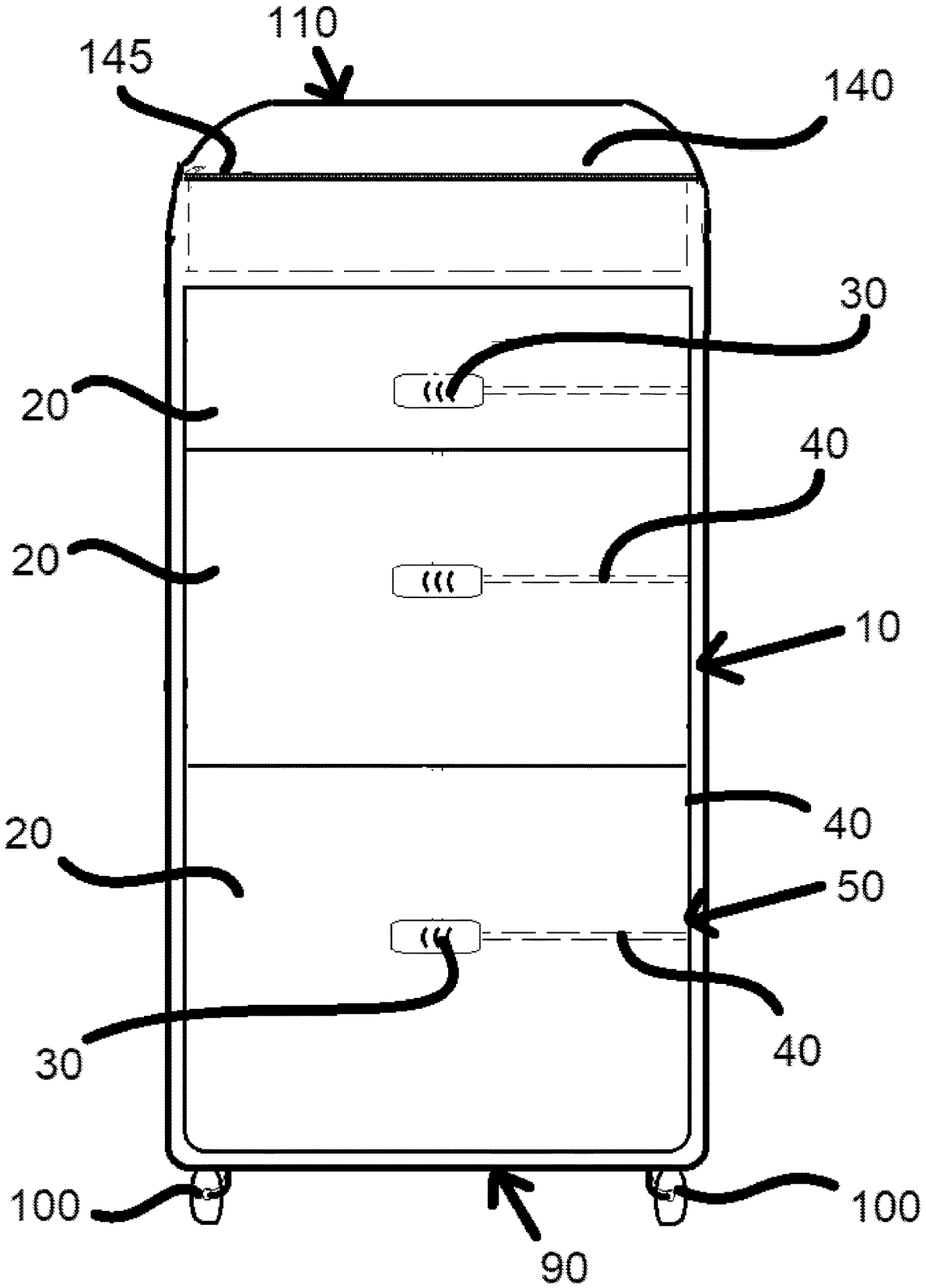
FIG. 1 depicts a view of the large embodiment of the apparatus of the present invention as seen from the front.

The present invention is a luggage system and method of use thereof configured to facilitate the organization of items for travel such that they are easily accessible and less prone to shifting during transit. The system includes two components: a large suitcase configured to be checked luggage shown in FIGS. 1, 2, 3, and 8, and a smaller suitcase configured with the dimensions of a carry-on luggage as shown in FIGS. 4 and 9. Both components as shown affixed together in FIG. 6. The preferred embodiment of the large suitcase of the present invention is equipped with a body (10) having drawers (20) which are preferably present in a horizontal orientation when the body (10) is maintained upright in a vertical orientation as shown in FIG. 1. There are preferably three drawers (20) present on the large suitcase of the system: a top drawer configured as a jewelry and/or small items drawer, a middle drawer, and a bottom drawer, which is the largest of the three drawers (20). The middle drawer and bottom drawer are preferably configured to primarily contain clothing. The bottom drawer is the largest to accommodate additional weight of items which helps aide the stability of the larger suitcase of the present invention.

Figure 7:
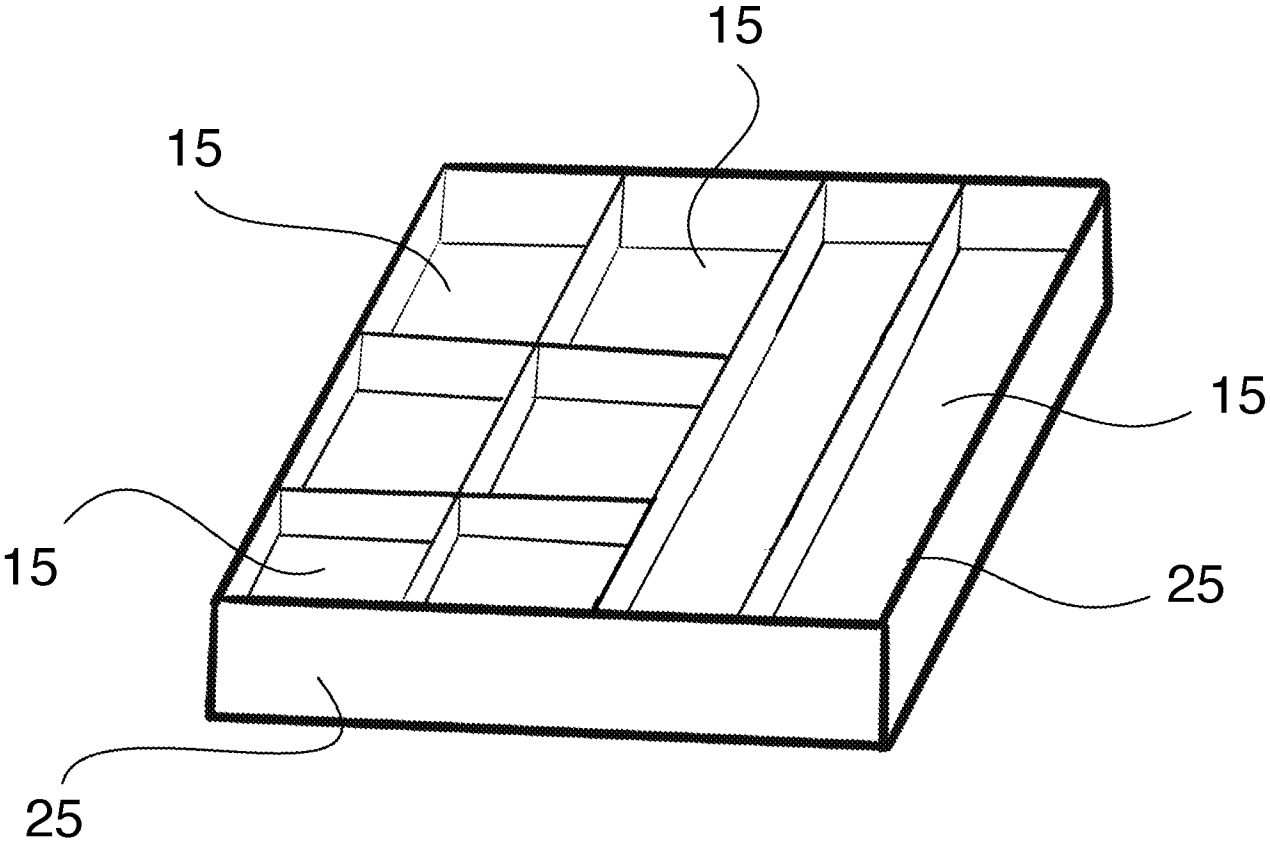
FIG. 7 depicts a view of the removable liner compartments present in each of the drawers of the present invention which facilitate easy unpacking and repacking of the luggage by the user.

The drawers (20) are preferably outfitted with removable liner compartments (25) as shown in FIG. 7. The removable liner compartments (25) function similarly to drawer organizers, exhibiting multiple cubbies (15) to segment the user's items within the drawer (20). The cubbies (15) of the removable liner compartments (25) have a bottom and four walls, and are joined together such that the entire contents of the drawers (20) may be removed easily when the removable liner compartments (25) are removed. For example, when the user arrives to his or her room, the user may easily unpack by removing the removable liner compartments (25) of the drawers if desired, and placing them on a flat surface or inside of dresser drawers of the room. The removable liner compartments (25) are preferably composed of a lightweight and sturdy fabric, or fabric sewn around thin plastic sheets. The removable liner compartment (25) of the jewelry or top drawer is preferably equipped with a top (35) (which encompasses all of the cubbies (15) of the removable liner compartments (25) which may be zippered, helping to ensure items remain in position. Other liner compartments (25) of the drawers (20) may be equipped with tops (35) as well.

Figure 2:
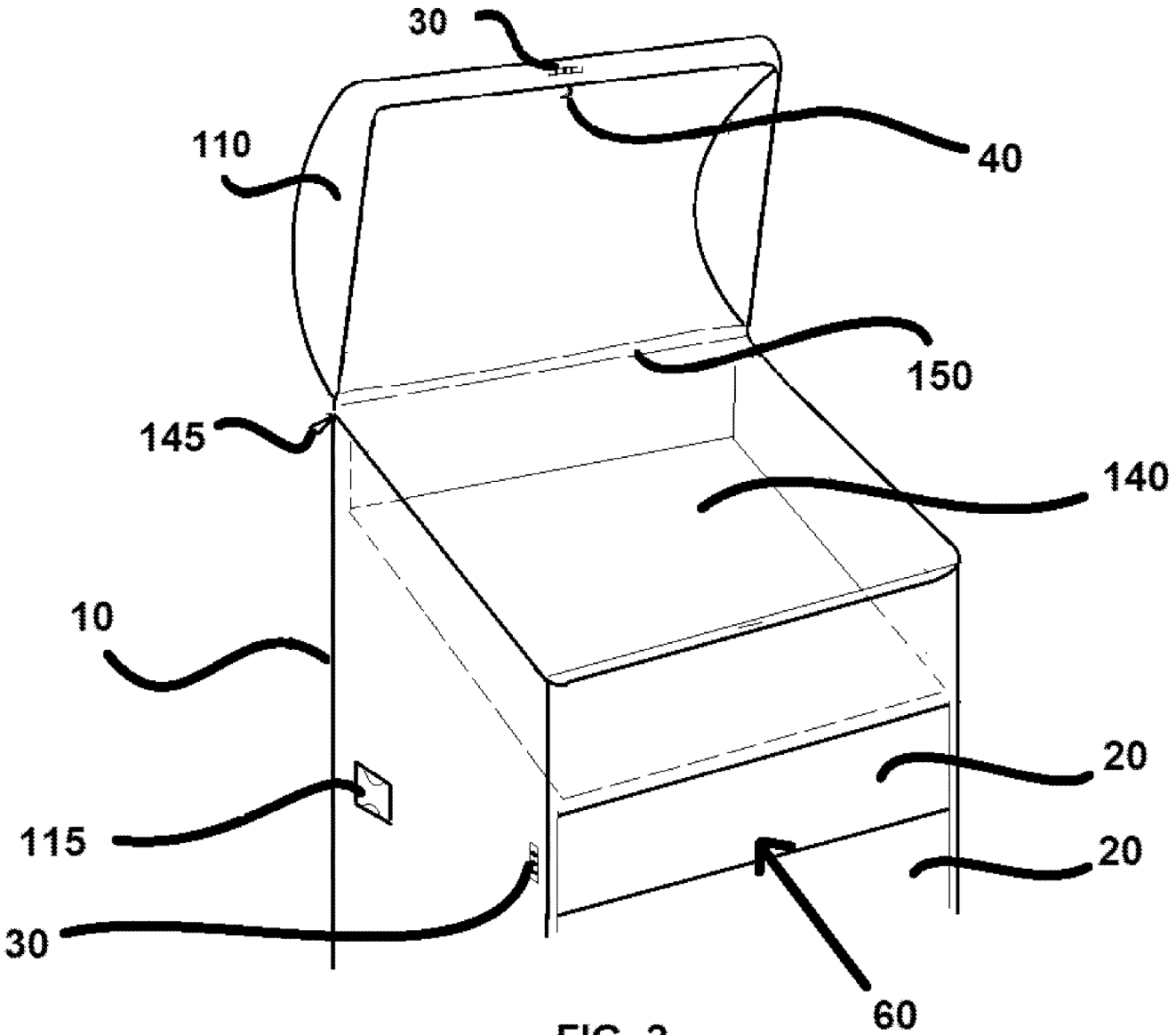
FIG. 2 exhibits a view of a second embodiment of the large embodiment of the apparatus of the present invention as seen from the front with the top opened, depicting the locking mechanisms on the side of the apparatus.

Each drawer (20) is preferably equipped with an individual lock (30) which is configured to bar the movement of the drawer (20) from out of the body (10) via latches (40) present on sides (50) of each drawer (20). The latches (40) are preferably present on at least two sides (50) of each drawer (20), and are configured to bind against sides of the body (10) to ensure adequate security, and to prevent the drawer (20) from inadvertently opening when subjected to shock, torsion, or similar stress prevalent to the transit of luggage. The lock (30) itself is preferably present on the sides of the body (10) of the apparatus, as shown in FIG. 2, however in alternate embodiments, the lock(s) (30) may be present in other locations including the center of each drawer (20) as shown in FIG. 1. In such embodiments, the lock (30) is a conventional swing-arm lock, configured to force a connection of the drawer (20) to a side of the body (10).

The drawers (20) are preferably solely configured to extend from a front (60) of the body (10). Each lock (30) is preferably a combination lock, however it is envisioned that other forms of locks may be employed, including, but not limited to biometric locks, keyed locks, and other conventional locking mechanisms. The body (10) of the apparatus of the present invention is equipped with a rear (70) exhibiting a primary zippered compartment (80) which is configured to fold down about a fabric hinge (90) disposed near a bottom (90) of the body (10).

Figure 3:
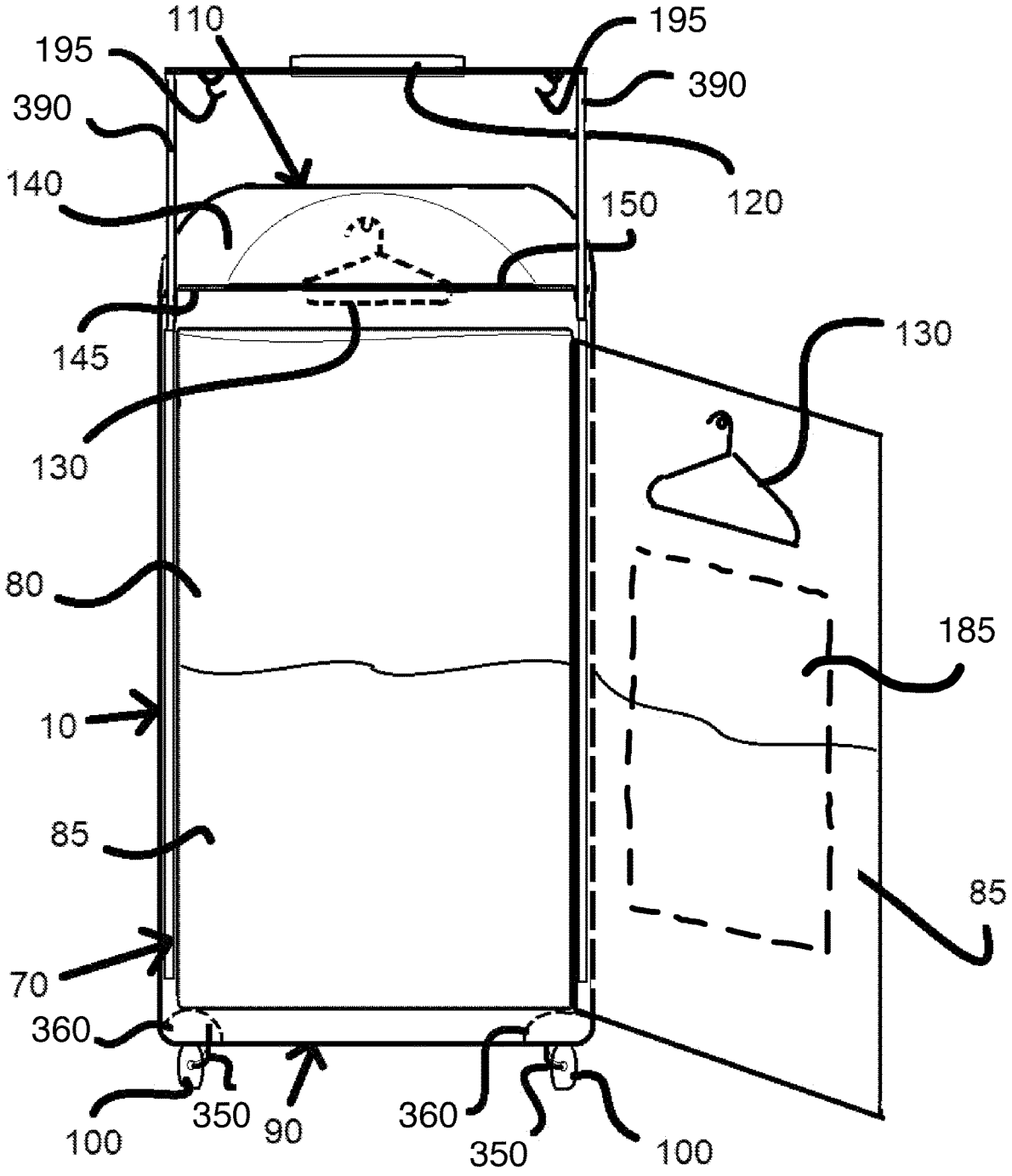
FIG. 3 depicts a perspective view of the interior of the large embodiment of the apparatus of the present invention as shown from the rear.
Figure 4:
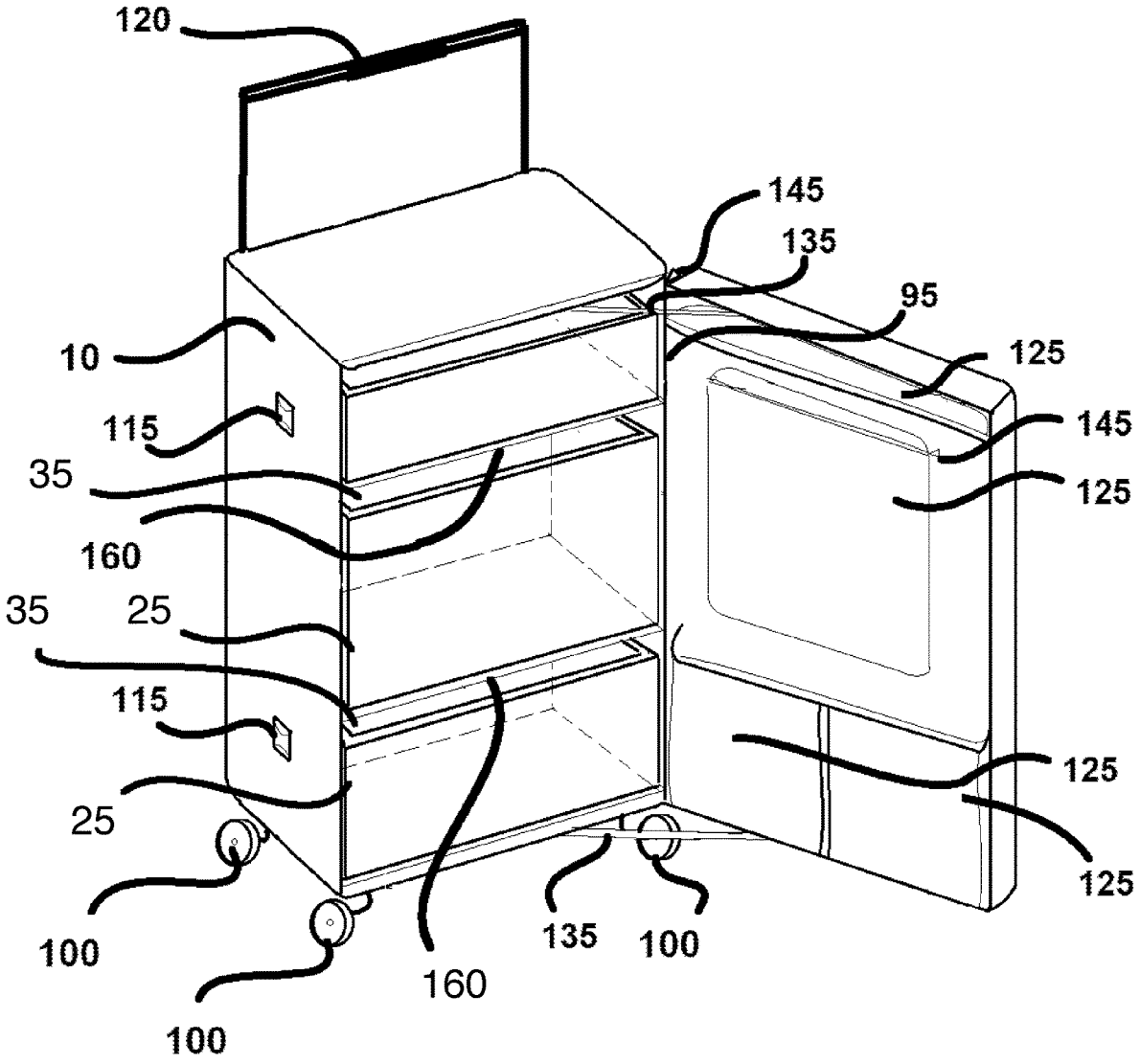
FIG. 4 details a view of the front of the carry-on embodiment of the apparatus of the present invention, opened to show the internal dividers.

Alternately, the primary zippered compartment (80) may be configured to open horizontally about a vertically disposed fabric hinge (95) as shown in FIG. 3 to reveal a storage cavity. Upon unzipping the primary zippered compartment (80), the bulk of the rear (70) of the apparatus folds down (or to the side), revealing the interior of the primary zippered compartment (80) which is substantially large enough to accommodate larger clothing items in a minimally folded state such as suits, dresses, and the like. At least one hanger (130) is preferably disposed within the primary zippered compartment (80) of the large embodiment of the present invention as shown in FIG. 3. Interior pockets (85) are preferably present within the primary zippered compartment (80) to additionally facilitate the secure positioning of larger clothing items. An elastic pocket (370) is preferably present on the right exterior side of the body (10) which extends along the a majority of the side of the body (10). The elastic pocket (370) is configured to contain dirty clothes which may not fit within the drawers (20) or primary zippered compartment (80). The elastic pocket (370) may be equipped with a zipper in some embodiments of the present invention.

The bottom (90) of the body (10) is preferably equipped with wheels (100) which are disposed at corners of the body (10) as shown in FIG. 1. There are preferably four wheels (100), one disposed at each corner of the bottom (90) of the body (10) of the present invention. The wheels (100) are preferably configured to retract into the bottom (90) of the body (10), within wheel-wells (360) when desired to aide in the stability of the apparatus when not in transit, and additionally when a drawer (20) is opened. Telescoping shafts (350) are preferably present within the wheel-well (360) of the bottom (90) of the body (10) of the apparatus which facilitate the extension and retraction of the wheels (100) via an integrated spring when desired. It should be noted that the wheels (100) are preferably manual, non-powered wheels, and are configured to extend and contract when manually manipulated by the owner. The wheels (100) preferably retract into the wheel-wells (360) when retracted.

The purpose of the retracting wheels (100) is to ensure that they are not damaged when the apparatus is inevitably thrown around in transit, which is especially prone to happen during air travel as it is known that in the loading and unloading process of luggage, luggage is often 'tossed' onto conveyor belts, carts, and trams in order to reach their destination. It should be understood that both the large embodiment shown in FIG. 1 and FIG. 3, as well as the smaller "carry-on" embodiment of the present invention as shown in FIG. 4 are equipped with identical retracting wheels (100) capable of rotating 360 degrees independently about a conventional vertical socket or axis.

A top (110) of the body (10) of all embodiments of the present invention is preferably equipped with a retractable handle (120) configured to extend up and away from the body (10) when desired. The retractable handle (120) is designed to be used as a stand to support at least one hanger to allow the user to move clothes from within the body (10) of the luggage to the retractable handle (120) if desired. The retractable handle (120) is equipped with a horizontal handle and two vertical supports (390). The vertical supports (390) of the retractable handle (120) preferably retract into the body (10) of the present invention, along sides of the body (10), at the outside of the primary zippered compartment (80) as shown in FIG. 3. As such, the horizontal handle is approximately the width of the body (10). The vertical supports preferably retract into vertical cavities within the body itself, on sides of the primary zippered compartment (80) as shown in FIG. 3. The vertical supports (390) are preferably approximately equal to the height of the body (10) such that, when the retractable handle (120) is fully extended, it is nearly double the height of the body (10). This enables the retractable handle (120) to function as a location to which the user may hang clothing via hangers when they are removed from the primary zippered compartment (80). The retractable handle (120) is preferably equipped with hooks (195) to enable the user to hang a purse, headphones, a hat, or other lightweight items when stationary.

Alternately, the vertical supports (390) of the retractable handle (120) may be configured to retract into an inaccessible void present behind a bottom of the primary zippered compartment (80).

Additionally, the top (110) of the large primary embodiment is equipped with a horizontal zippered compartment (140) shown in FIG. 2 which, when opened via a zipper (145), is configured to open upwards about a horizontal top fabric hinge (150). The horizontal zippered compartment (140) of the top (110) of the apparatus is suited to store large items such as shoes, boots, a hair dryer, shampoo and conditioner, a video camera, or similar items. The top (110) is preferably shaped like a globe with a curved, hardened material hosting the zipper of the horizontal zippered compartment (140).

At least one embodiment of the present invention is equipped with at least one power source, preferably in the form of rechargeable batteries or a conventional rechargeable battery pack which may be included separately. The power source is preferably configured to provide power to portable electronic devices such as tablets, cell phones, and similar mobile devices when connected to the power source with a charging cable. The power source is preferably housed within a battery pocket (180) of the apparatus of the present invention, and is ideally available on the carry-on embodiment of the present invention as shown in FIG. 2. The battery pocket (180) is located adjacent to a mobile device pocket (185). A conduit (190) is present between the battery pocket (180) and the mobile device pocket (185) which provides for the passage of a charging cable between the battery pocket (180) and the mobile device pocket (185) as shown in FIG. 2. A tablet/magazine pocket (175) is preferably present behind the mobile device pocket (185) and battery pocket (180), and may also be equipped with a conduit (190) for the passage of a charging cable.

Additionally, it should be noted that the carry-on embodiment (smaller embodiment shown in FIG. 4) is preferably not equipped with drawers (20), but instead is equipped with dividers (160) which function similar to shelves when upright as shown in FIG. 4, or divided pockets when the carry-on embodiment is laid down. These dividers (160) of the carry-on embodiment may preferably be removed from the body (10) of the carry-on embodiment if desired by the user. As with the large embodiment, the carry-on embodiment is preferably also equipped with reinforced fabric liners, referenced as removable liner compartments (25), each of which is equipped with a fabric top (35) which is preferably capable of being zipped closed to securely contain the contents of each shelf. Walls (325) are present to form the cubbies (15) within the removable liner compartments (25).

The interior of the carry-on embodiment, as shown in FIG. 4, is preferably equipped with internal pockets (125) disposed on the door-like opening, which are configured to hold smaller items such as toiletries and devices securely. The internal pockets (125) may be equipped with zippers or clasps in some embodiments. Extension straps (135) are preferably present, extending from the door-like opening (155) to the body (10) of the apparatus to help aide the structure of the apparatus when open as shown in FIG. 4.

Figure 6:
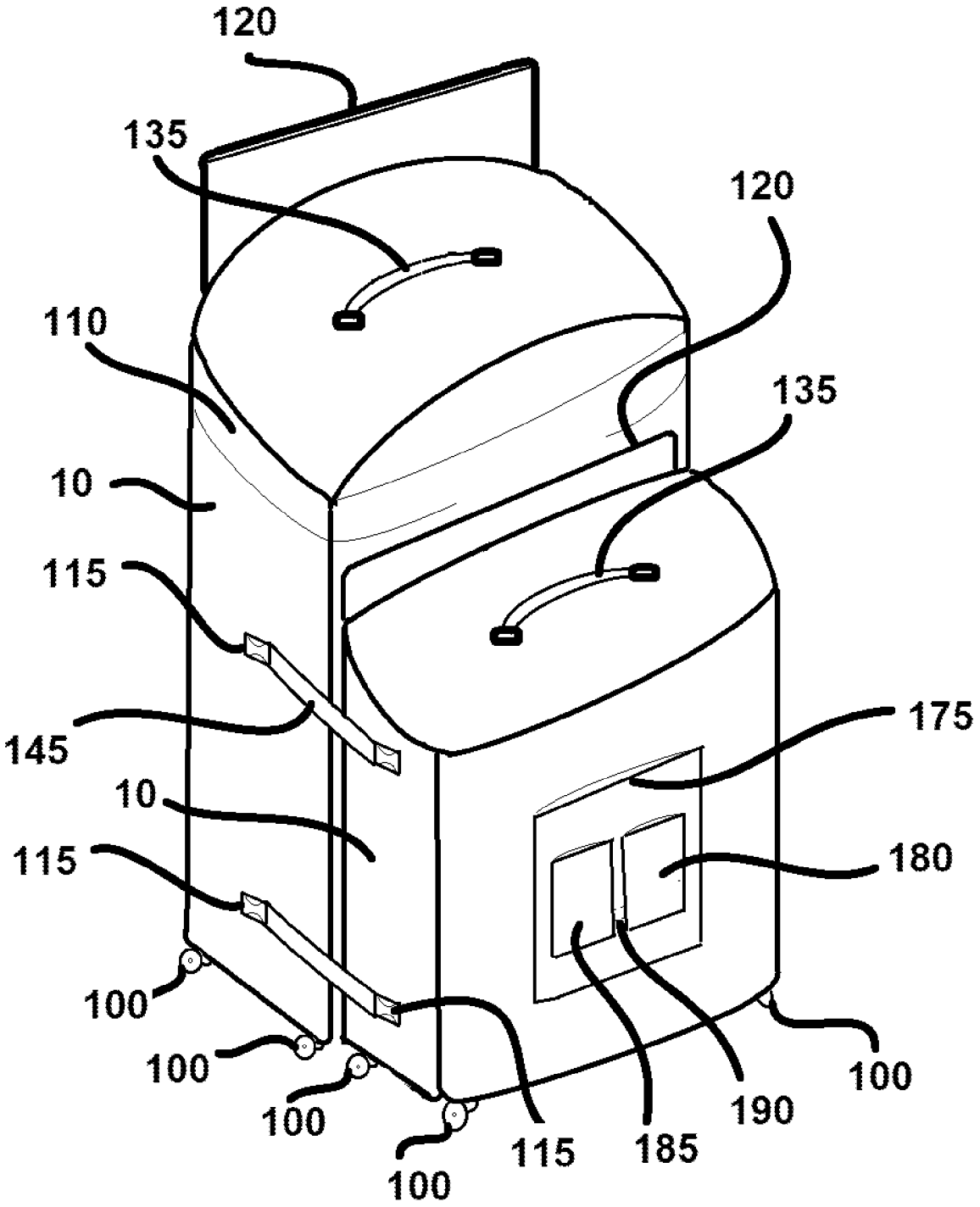
FIG. 6 depicts a view of the side of both the carry-on embodiment and large embodiment of the present invention, attached

Retaining clips (115) are preferably present on the left and right sides of the apparatus in all embodiments of the present invention and are configured to facilitate the attachment of the carry-on embodiment to the large embodiment for ease of transport as a unitary luggage ensemble as shown in FIG. 6. There are preferably two retaining clips (115) on both the right side and the left side of each embodiment of the apparatus. It is envisioned that the retaining clips (115) may be one of a variety of conventional clasps, buckles, clips, hooks, and the like to adequately bind the two luggage items together temporarily such that a single retractable handle (120) from either the carry-on embodiment or the large embodiment may be employed to facilitate transport of the luggage ensemble via the wheels (100) of both embodiment. Retaining straps (145) are employed in conjunction with the retaining clips (115) to facilitate the connection of the small carry-on embodiment to the larger embodiment as shown in FIG. 6. Standard carry handles (135) may also be present on the top of both embodiments as shown in FIG. 6.

Figure 5:
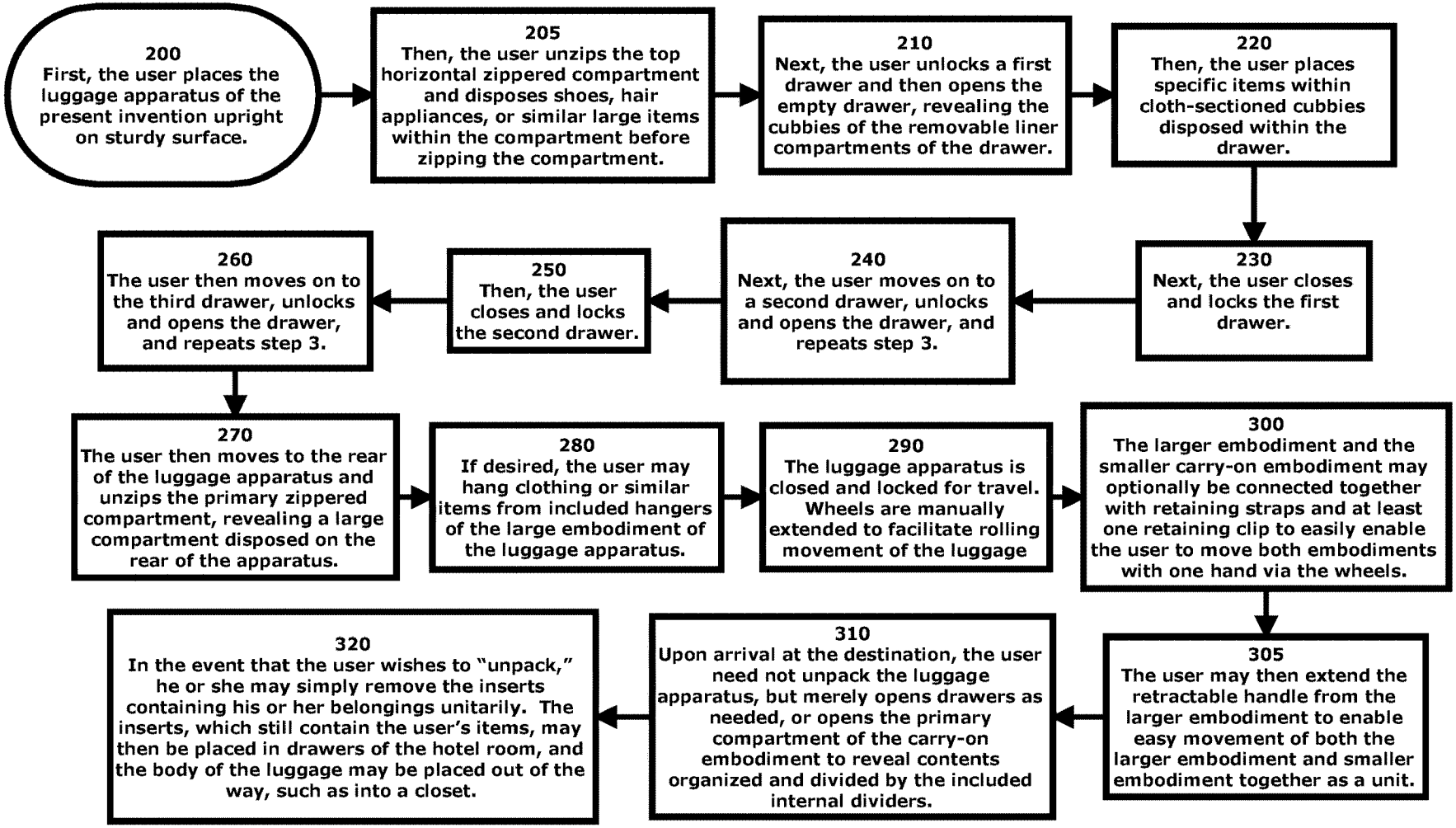
FIG. 5 shows a flow chart detailing the process of use of the present invention by a user.

The process of installation and use of the system and apparatus of the present invention, as shown in FIG. 5, is preferably as follows:

1. First, the user places the luggage apparatus of the present invention upright on sturdy surface. (200)
2. Then, the user unzips the top horizontal zippered compartment and disposes shoes, hair appliances, or similar large items within the compartment before zipping the compartment. (205)
3. Next, the user unlocks a first drawer and then opens the empty drawer, revealing the cubbies of the removable liner compartments of the drawer. (210). The first drawer is ideally configured to hold jewelry and similar small items for safe and secure travel. It should be understood that the jewelry drawer may have jewelry specific storage mechanisms such as rails, necklace pegs, earring stands, etc., and is configured to store conventional jewelry such as rings, necklaces, bracelets, earrings, broaches, and similar items.
4. Then, the user places specific items within cloth-sectioned cubbies disposed within the drawer. (220) If desired, the user may remove the removable liner compartments and fill them externally from the drawer, then replacing the now filled compartments to the drawer.
5. Next, the user closes and locks the first drawer. (230)
6. Next, the user moves on to a second drawer, unlocks and opens the drawer, and repeats step 3. (240)
7. Then, the user closes and locks the second drawer. (250)
8. The user then moves on to the third drawer, unlocks and opens the drawer, and repeats step 3. (260)
9. The user then moves to the rear of the luggage apparatus and unzips the primary zippered compartment, revealing a large compartment disposed on the rear of the apparatus. (270)
10. If desired, the user may hang clothing or similar items from included hangers of the large embodiment of the luggage apparatus. (280)
11. The luggage apparatus is closed and locked for travel. Wheels are manually extended to facilitate rolling movement of the luggage. (290)
12. The larger embodiment and the smaller carry-on embodiment may optionally be connected together with retaining straps and at least one retaining clip to easily enable the user to move both embodiments with one hand via the wheels. (300) In some embodiments, a retractable table may be used to further connect the two embodiments as detailed later in the specification.
13. The user may then extend the retractable handle from the larger embodiment to enable easy movement of both the larger embodiment and smaller embodiment together as a unit. (305)
14. Upon arrival at the destination, the user need not unpack the luggage apparatus, but merely opens drawers as needed, or opens the primary compartment of the carry-on embodiment to reveal contents organized and divided by the included internal dividers. (310)
15. In the event that the user wishes to "unpack," he or she may simply remove the inserts containing his or her belongings unitarily. The inserts, which still contain the user's items, may then be placed in drawers of the hotel room, and the body of the luggage may be placed out of the way, such as into a closet. (320)

It should be noted that the retaining clips (115) may be located in other locations rather than solely the sides of the bodies of the luggage system. For example, retaining clips (115) may be present solely on the back and/or side portions of both the carry-on embodiment and larger full-size embodiment such that they may be connected back-to-back if desired by the user. Additionally, it should be understood that both the full-size embodiment and carry-on embodiment should be seen as a luggage system, each having a body (10), at least one storage compartment preferably secured via at least one zipper, a retractable handle (120), and wheels (100). Drawers (20) are preferably solely present on the larger full-size embodiment.

Figure 8:
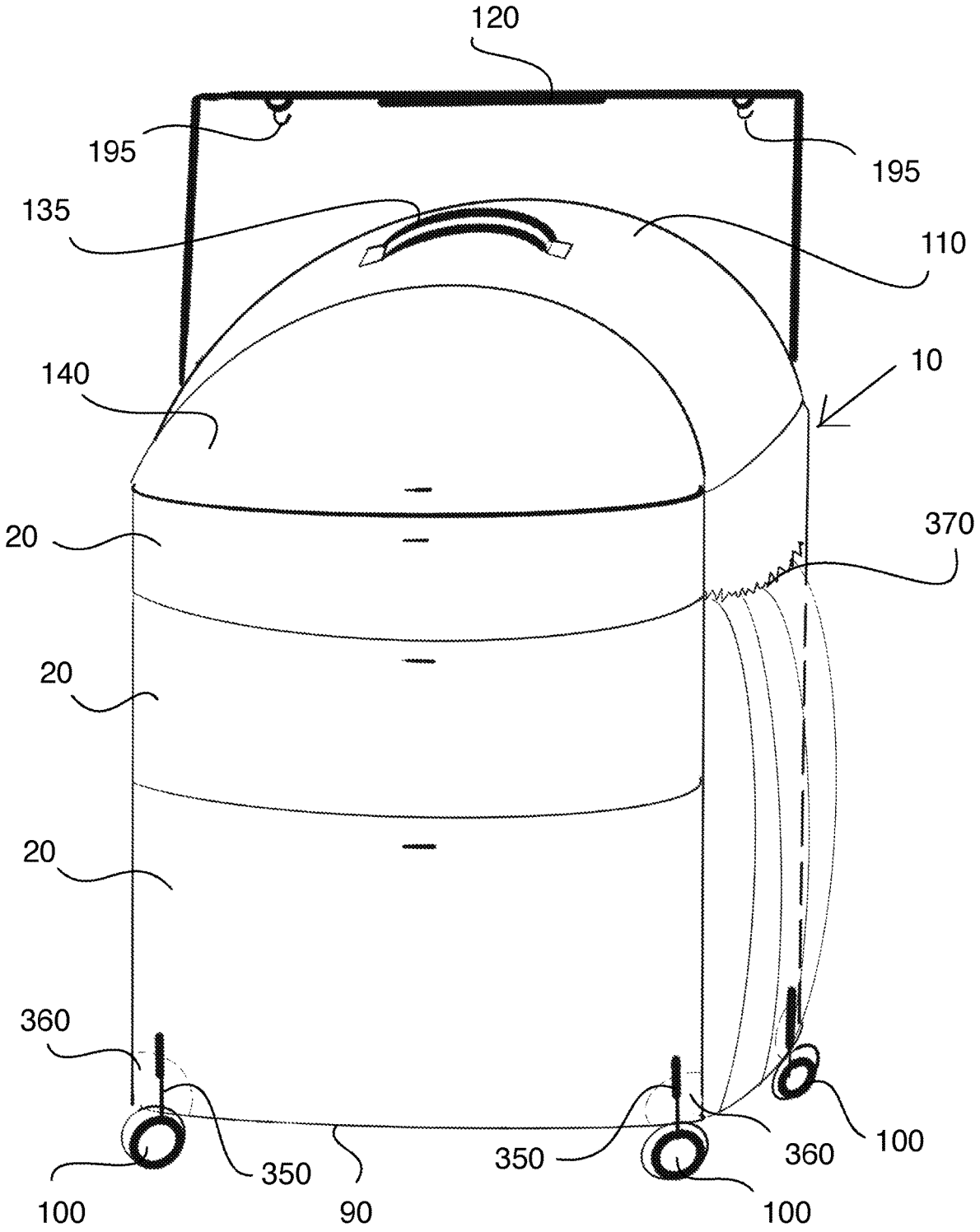
FIG. 8 exhibits a view of the elastic pocket of the present invention, as well as views of the wheel-wells of the present invention.
Figure 9:
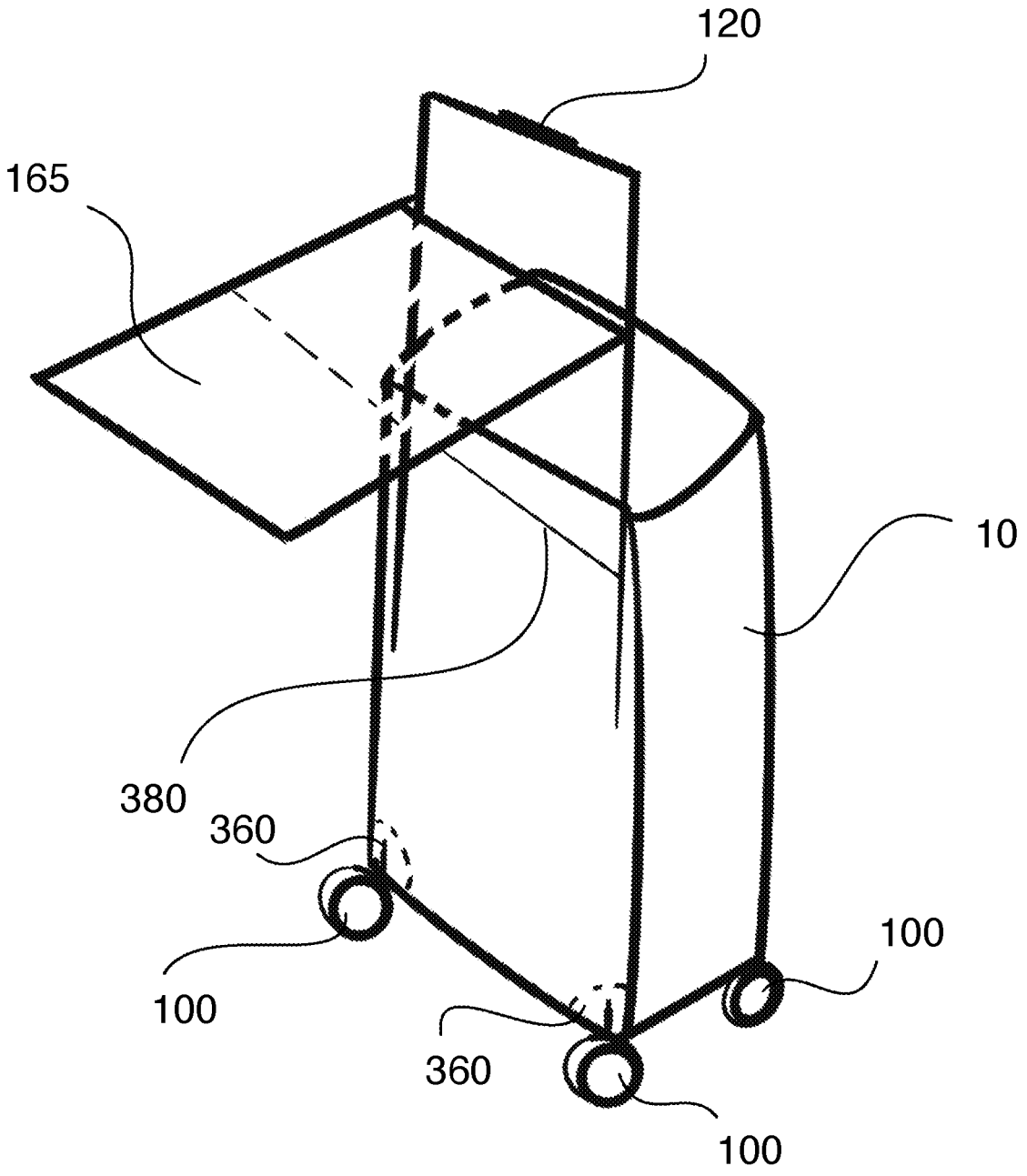
FIG. 9 depicts a view of the retractable table of the present invention as disposed on the carry-on embodiment.

Some embodiments of the present invention are preferably equipped with a retractable table (165) as shown in FIG. 8. The retractable table (165) is disposed in communication with the vertical supports of the retractable handle (120) and is configured to pivot up and away from the retractable handle (120) when use of the retractable table (165) is needed. The retractable table (165) is preferably composed of lightweight, high-density plastic to minimize the weight of the apparatus. At least one pivoting support (380) is preferably present to ensure that the retractable table (165) remains level when extended. The at least one pivoting support (380) is conventional, similar to the non-hydraulic support of an automotive hood. When retracted, the retractable table (165) is configured to rest flush against the side of the smaller, carry-on embodiment of the present invention. When the carry-on is connected to the larger embodiment the retractable table (165) is preferably configured to slide into an exterior open pocket (185) of the rear of the primary zippered compartment (80) as shown in FIG. 8, helping to protect the retractable table (165) during transit, as well as to help ensure that the carry-on remains attached to the larger embodiment. In effect, joining the large embodiment to the carry-on embodiment may be accomplished via this method in lieu of, or in addition to, the use of the straps and retention clips.

The height of the retractable table (165) of the present invention, when extended, may be altered by adjusting the height of the retractable handle (120). The retractable table (165) is useful in airports, bus stops, train stations, or similar locations as it provides a place to sit next to and eat snacks, play cards, work on a laptop, or other similar lightweight activities. Similarly, the retractable table (165) may be useful to allow the user's kids to eat, draw, or play on a tablet computer. In some embodiments of the retractable table (165), an additional support member may be present which is configured to extend to the floor, further ensuring stability of the retractable table (165) when in use.

Figure 10:
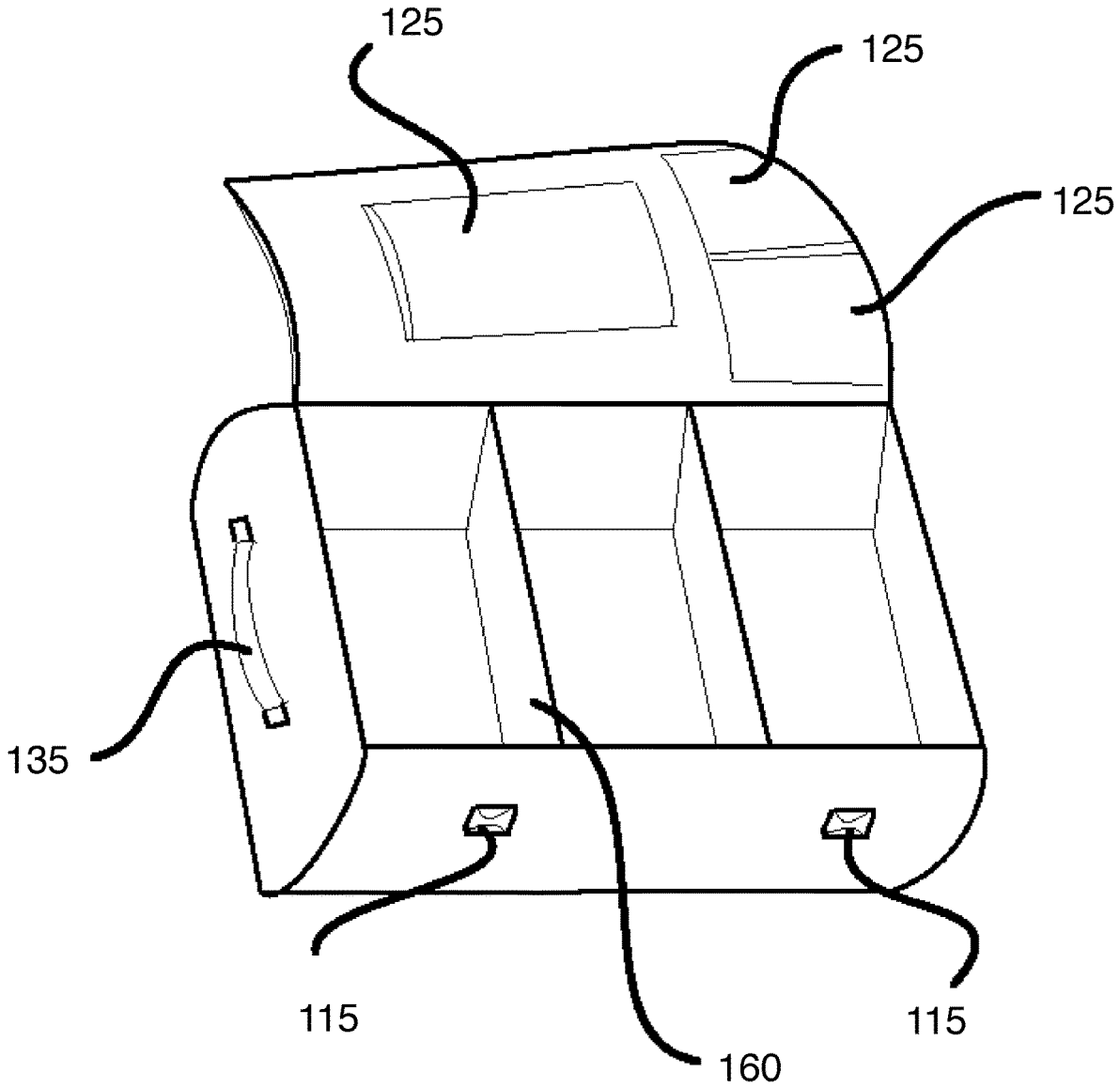
FIG. 10 shows a view of the carry-on embodiment of the present invention, equipped with dividers, depicted laying on its side.

Further, it should be noted that the carry-on embodiment, as detailed in FIG. 4, may be used in multiple orientations, with or without the dividers (160), with or without the removable compartments (25), or any combination thereof. Additionally, with the dividers (160) removed, the carry-on embodiment may function like a standard suitcase with one large compartment if desired. The carry-on embodiment may be loaded while laid on its side as shown in FIG. 10, equipped with the dividers (160) if desired. It should be noted that the removable liner compartments (25) are preferably reinforced with a plastic polymer or cardboard composite to ensure that they keep their shape.

Having illustrated the present invention, it should be understood that various adjustments and versions might be implemented without venturing away from the essence of the present invention. Further, it should be understood that the present invention is not solely limited to the invention as described in the embodiments above, but further comprises any and all embodiments within the scope of this application.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

I claim:

1. A system for packing and unpacking luggage by a user comprising:

placing a first luggage apparatus upright in a vertical orientation, the first luggage apparatus equipped with a top drawer, a middle drawer, a bottom drawer, a primary zippered compartment, and a horizontal zippered compartment;

wherein the top drawer, middle drawer, and bottom drawer are equipped with removable liner compartments;

wherein the top drawers is the smaller than the middle drawer and the bottom drawer;

wherein said bottom drawer is larger than the middle drawer and the top drawer;

opening the top drawer;

inserting a first set of personal items into the removable liner compartments of the top drawer, the first set of personal items exhibiting a small stature;

closing the top drawer;

opening the middle drawer;

inserting a second set of personal items into the removable liner compartments of the middle drawer, the second set of personal items being clothing;

closing the middle drawer;

opening the bottom drawer;

inserting a third set of personal items into the removable liner compartments of the bottom drawer, the third set of personal items being items of larger stature;

closing the bottom drawer;

locking the top drawer, middle drawer, and bottom drawer;

opening the horizontal zippered compartment, the horizontal zippered compartment disposed on a top of the first luggage apparatus;

placing non-clothing items in the horizontal zippered compartment;

closing the horizontal zippered compartment;

opening the primary zippered compartment;

hanging at least one clothing item on a hanger disposed within the primary zippered compartment; and closing the primary zippered compartment.

2. The system of claim 1, further comprising:

placing a second luggage apparatus in a horizontal position on the floor;

wherein the second luggage apparatus is a carry-on luggage;

wherein the second luggage apparatus is smaller in height and width than the first luggage apparatus, and equal in length to the first luggage apparatus;

opening a primary zippered compartment of the second luggage apparatus, revealing dividers within the compartment;

placing items into the primary zippered compartment of the second luggage apparatus between the dividers;

closing the primary zippered compartment of the second luggage apparatus;

placing one or more items into exterior pockets of the second luggage apparatus, the items selected from the following group: a tablet computer, a laptop computer, magazines, a passport, a mobile device, a mobile device charger; and routing a wire through a conduit present between the exterior pockets, the wire connecting to an electronic device and the mobile device charger.

3. The system of claim 2, further comprising:

connecting the first luggage apparatus to the second luggage apparatus via retaining straps and retaining clips;

extending a retractable handle from the first luggage apparatus;

extending four retractable wheels from within wheelwells disposed on a bottom of the first luggage apparatus;

extending four retractable wheels from within wheelwells disposed on a bottom of the second luggage apparatus;

wherein the retractable wheels are configured to revolve around a vertical axis to permit 360 degrees of movement individually; and using the retractable handle to move the first luggage apparatus and second luggage apparatus together as a unit about the wheels.

4. The system of claim 3, further comprising:

placing the first luggage apparatus and second luggage apparatus in a room in an upright position;

disconnecting the first luggage apparatus from the second luggage apparatus by releasing the retaining clips;

fully extending the retractable handle;

retracting the retractable wheels of the first luggage apparatus such that the bottom of the first luggage apparatus rests directly on the floor of the room;

opening the top drawer;

removing the removable liner compartments of the top drawer containing the first set of personal items without removing the first set of personal items from the removable liner compartments, unpacking the entirety of the top drawer with one motion;

closing the top drawer;

opening the middle drawer;

removing the removable liner compartments of the middle drawer containing the second set of personal items without removing the second set of personal items from the removable liner compartments, unpacking the entirety of the middle drawer with one motion;

closing the middle drawer;

opening the bottom drawer;

removing the removable liner compartments of the bottom drawer containing the third set of personal items without removing the third set of personal items from the removable liner compartments, unpacking the entirety of the bottom drawer with one motion;

closing the bottom drawer;

opening the primary zippered compartment;

removing the at least one clothing item on a hanger without removing the at least one clothing item from the hanger;

hanging the hanger on a hook disposed on the fully extended retractable handle such that the hanger is parallel to the retractable handle; and wherein a primary axis of the hook is perpendicular to a primary axis of the retractable handle.

5. The system of claim 4, further comprising:

extending a retractable table from a rear of the second luggage apparatus and supporting the retractable table in a level position via at least one pivoting support.

6. A luggage system comprising:

a first body, said first body roughly approximating a three-dimensional rectangle equipped with a first hollow storage cavity;

wherein said first hollow storage cavity is segmented;

a first set of wheels, said first set of wheels disposed on a bottom of said body;

a first retractable handle, said first retractable handle extending up and away from a top of said first body;

wherein said first retractable handle has a length approximately equal to a length of said first body;

drawers, said drawers disposed on a front of said body;

wherein said drawers are configured to open such that they extend out and away from said body individually;

latches, said latches disposed in communication with said drawers;

locks, said locks disposed in communication with said latches;

a rear compartment, said rear compartment configured to open horizontally about a vertical fabric hinge via a zipper while said first body remains in an upright position;

a second body, said second body smaller in height and width than said second body, and equal in length to said first body;

wherein said second body is equipped with a second hollow storage cavity;

a second set of wheels, said second set of wheels disposed on a bottom of said second body;

wherein said second body is configured to open about a fabric hinge, revealing the second hollow storage cavity;

dividers, said dividers present within said second hollow storage cavity;

a second retractable handle, said second retractable handle configured to extend up and away from top of said second body; and exterior pockets, said pockets disposed on an exterior of a front of said second body.

* * * * *